US011655825B2

(12) United States Patent
Halbe et al.

(10) Patent No.: US 11,655,825 B2
(45) Date of Patent: May 23, 2023

(54) COMPRESSOR INCLUDING AERODYNAMIC SWIRL BETWEEN INLET GUIDE VANES AND IMPELLER BLADES

(71) Applicant: CARRIER CORPORATION, Palm Beach Gardens, FL (US)

(72) Inventors: Chaitanya Vishwajit Halbe, New Haven, CT (US); Vishnu M. Sishtla, Syracuse, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/407,489

(22) Filed: Aug. 20, 2021

(65) Prior Publication Data

US 2023/0057749 A1 Feb. 23, 2023

(51) Int. Cl.

| | |
|---|---|
| ***F04D 27/02*** | (2006.01) |
| ***F04D 29/68*** | (2006.01) |
| ***F04D 29/46*** | (2006.01) |
| *F04D 17/10* | (2006.01) |

(52) U.S. Cl.

CPC ..... *F04D 27/0246* (2013.01); *F04D 27/0238* (2013.01); *F04D 29/462* (2013.01); *F04D 17/10* (2013.01)

(58) Field of Classification Search

CPC . F04D 29/684; F04D 27/0238; F04D 27/0246
See application file for complete search history.

(56) References Cited

U.S. PATENT DOCUMENTS

| | | | | |
|---|---|---|---|---|
| 2,656,096 | A * | 10/1953 | Schwarz | F04D 29/684 417/323 |
| 2,690,293 | A * | 9/1954 | Muhlberg | F04D 29/684 415/145 |
| 3,041,848 | A * | 7/1962 | Greenwald | F25B 1/053 62/197 |
| 5,458,457 | A * | 10/1995 | Goto | F04D 29/661 415/115 |
| 8,287,232 | B2 * | 10/2012 | Gu | F04D 27/0215 415/57.1 |
| 9,732,756 | B2 * | 8/2017 | An | F04D 29/462 |
| 10,451,087 | B2 * | 10/2019 | Richards | F04D 25/06 |
| 10,815,886 | B2 * | 10/2020 | Kroger | F04D 29/541 |

(Continued)

FOREIGN PATENT DOCUMENTS

WO 2017/023578 A1 2/2017

*Primary Examiner* — Justin D Seabe
(74) *Attorney, Agent, or Firm* — Carlson, Gaskey & Olds, P.C.

(57) ABSTRACT

An illustrative example embodiment of a compressor includes an inlet defining an intake passage, a plurality of inlet guide vanes, an impeller, and a plurality of swirl nozzles. Fluid flow through the plurality of inlet guide vanes into the intake passage is selectively adjustable to control fluid flow through at least the portion of the intake passage downstream of the swirl nozzles. The impeller includes a plurality of blades and directs fluid from the intake passage toward an outlet. The swirl nozzles have outlets positioned downstream of the plurality of inlet guide vanes and upstream of the impeller. The swirl nozzles are configured to introduce fluid into the intake passage to cause swirl of fluid in the intake passage between the plurality of inlet guide vanes and the impeller.

13 Claims, 1 Drawing Sheet

(56) References Cited

U.S. PATENT DOCUMENTS

| | | | | |
|---|---|---|---|---|
| 2013/0000315 | A1* | 1/2013 | Mowill | F04D 29/4213 60/39.23 |
| 2014/0356128 | A1* | 12/2014 | Bindl | F04D 27/02 415/117 |
| 2015/0377250 | A1 | 12/2015 | Shistla | |
| 2019/0249681 | A1* | 8/2019 | Sishtla | F04D 27/0253 |

* cited by examiner

COMPRESSOR INCLUDING AERODYNAMIC SWIRL BETWEEN INLET GUIDE VANES AND IMPELLER BLADES

BACKGROUND

Compressors are used for a variety of purposes when pressurized fluid or gas is needed. For example, refrigerant circuits utilize pressurized refrigerant to achieve cooling for refrigeration or air conditioning. A variety of compressor configurations have been used in refrigerant circuits.

One challenge associated with some compressors is achieving optimum efficiency during a variety of operating conditions. For example, the compressor may not need to operate at full capacity under so-called part-load conditions. It would be useful to avoid aerodynamic losses in the impeller under such conditions because such losses negatively affect the compressor efficiency and surge margin.

SUMMARY

An illustrative example embodiment of a compressor includes an inlet defining an intake passage, a plurality of inlet guide vanes, an impeller, and a plurality of swirl nozzles. Fluid flow through the plurality of inlet guide vanes into the intake passage is selectively adjustable to control fluid flow through at least the portion of the intake passage downstream of the swirl nozzles. The impeller includes a plurality of blades and directs fluid from the intake passage toward an outlet. The swirl nozzles have outlets positioned downstream of the plurality of inlet guide vanes and upstream of the impeller. The swirl nozzles are configured to introduce fluid into the intake passage to cause swirl of fluid in the intake passage between the plurality of inlet guide vanes and the impeller In addition to one or more of the features described above, or as an alternative, the compressor includes at least one control valve, the plurality of swirl nozzles receive fluid from the outlet, and the at least one control valve controls an amount of the received fluid that is introduced into the intake passage.

In addition to one or more of the features described above, or as an alternative, the at least one control valve controls the amount of the fluid from the outlet provided to more than one of the plurality of swirl nozzles.

In addition to one or more of the features described above, or as an alternative, the at least one control valve comprises a plurality of control valves and each of the plurality of swirl nozzles is associated with one of the plurality of control valves.

In addition to one or more of the features described above, or as an alternative, a direction of fluid introduction into the intake passage from at least some of the swirl nozzles is selectively adjustable to change a characteristic of the swirl of fluid.

In addition to one or more of the features described above, or as an alternative, the plurality of swirl nozzles are equidistantly spaced around a circumference of the intake passage In addition to one or more of the features described above, or as an alternative, a controller controls at least one of an amount of fluid flowing through the plurality of swirl nozzles and a direction of fluid flow from the plurality of swirl nozzles.

In addition to one or more of the features described above, or as an alternative, the controller controls to control a flow rate of fluid upstream of the impeller.

In addition to one or more of the features described above, or as an alternative, the controller controls an incidence angle of fluid flow onto the blades of the impeller.

In addition to one or more of the features described above, or as an alternative, the controller determines when the compressor operates in a part-load condition and controls the at least one of the amount of fluid flow through the plurality of swirl nozzles and the direction of fluid flow from the plurality of swirl nozzles based on the part-load condition.

In addition to one or more of the features described above, or as an alternative, the controller increases the amount of fluid flow through at least one of the plurality of swirl nozzles when the compressor operates in the part-load condition.

In addition to one or more of the features described above, or as an alternative, the controller increases the amount of fluid flow through all of the plurality of swirl nozzles when the compressor operates in the part-load condition.

In addition to one or more of the features described above, or as an alternative, the swirl of fluid in the intake passage caused by the plurality of swirl nozzles establishes an incidence angle of fluid encountering the impeller blades along at least a portion of a leading edge of the blades that achieves a selected compressor efficiency.

In addition to one or more of the features described above, or as an alternative, the impeller includes a hub at a center of the blades, the impeller includes a shroud near radially outer ends of the blades, the leading edges of the blades have a length between the hub and the shroud, and the established incidence angle varies along the length of the leading edges of the blades.

In addition to one or more of the features described above, or as an alternative, the established incidence angle is optimized for each location along the length of the leading edge of the blades.

The various features and advantages of at least one disclosed example embodiment will become apparent to those skilled in the art from the following detailed description. The drawings that accompany the detailed description can be briefly described as follows.

DETAILED DESCRIPTION

Figure 1:
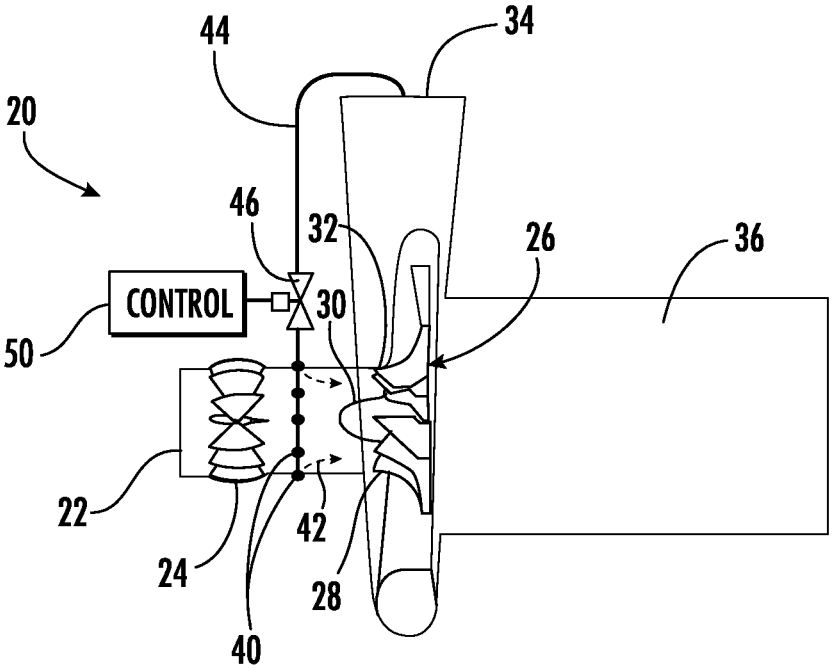
FIG. 1 schematically illustrates an example embodiment of a compressor including aerodynamic pre-swirl.

FIG. 1 schematically illustrates selected features of an example embodiment of a compressor 20. An inlet 22 defines an intake passage. The inlet 22 includes a plurality of inlet guide vanes 24 that are selectively controlled to adjust an amount of fluid flow through the intake passage. For example, the inlet guide vanes 24 are rotatable about respective radial axes to at least partially reduce the open area within the intake passage when reduced flow is desired.

An impeller 26 includes a plurality of blades 28 that have leading edges extending between a hub 30 at a center of the impeller 26 and a shroud 32 at an outer boundary of the impeller 26. As the impeller 26 rotates, the blades 28 draw fluid from the intake passage of the inlet 22, pressurize it, and direct it through an outlet 34.

A drive section 36 includes a motor for driving the impeller 26. In some embodiments, the drive section 36 includes gears between the motor and the impeller 26 to selectively control the speed of rotation of the impeller 26.

A plurality of swirl nozzles 40 have outlets that introduce fluid, which is schematically shown at 42, into the intake passage of the inlet 22. The outlets of the swirl nozzles 40 are situated in the intake passage downstream of the inlet guide vanes 24 and upstream of the impeller 26. For example, the plurality of swirl nozzles 40 may be equidistantly (or approximately) spaced around a circumference of the intake passage of the inlet 22. The swirl nozzles 40 introduce a desired swirl in the fluid within the portion or section of the intake passage that is between the inlet guide vanes 24 and the impeller 26.

In the illustrated example embodiment, the swirl nozzles 40 receive pressurized fluid, such as refrigerant, from the outlet 34. A nozzle supply conduit or manifold 44 provides the fluid to the swirl nozzles 40. The nozzle supply conduit or manifold 44 includes at least one control valve 46. A controller 50, which includes a computing device such as a microprocessor, controls operation of the control valve 46 to regulate how much fluid is introduced to achieve a desired amount of swirl in the intake passage upstream of the impeller 26.

The outlets of the swirl nozzles 40 are between the inlet guide vanes 24 and the impeller 26 to ensure a desired swirl of fluid encountering the leading edges of the blades 28 of the impeller 26. The inlet guide vanes 24 tend to affect characteristics of fluid flow within the intake passage in a manner that results in an increased work input under at least some conditions. This is particularly true during part-load conditions in which the compressor 20 is operating at less than full capacity. For example, the controller 50 may increase the amount of fluid flow through at least one of the plurality of swirl nozzles 40 when the compressor 20 is operating in a part-load condition. The swirl introduced downstream of the inlet guide vanes 24 by the swirl nozzles 40 compensates for or negates any undesired or negative effect of the inlet guide vanes 24. The swirl introduced by the swirl nozzles 40 controls, for example, the incidence angle of the fluid encountering the leading edges of the blades 28, which results in less work input and increased compressor efficiency.

The controller 50 is configured or programmed to control operation of the swirl nozzles 40 to achieve desired swirl and interaction between the impeller blades 28 and the fluid encountering the leading edges of the blades 28. For example, the controller 50 receives information regarding the operating condition of the compressor 20 and determines how much, if any, swirl is needed to achieve or approach a desired compressor efficiency.

Figure 2:
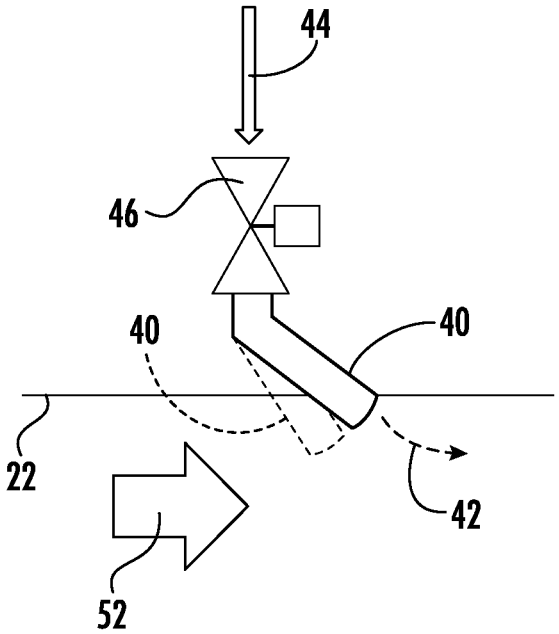
FIG. 2 schematically illustrates an example embodiment of a nozzle and valve configuration.

FIG. 2 schematically illustrates one of the swirl nozzles 40. In this example embodiment, each swirl nozzle 40 has an associated control valve 46 so that each swirl nozzle 40 is individually controllable. In other embodiments, a control valve 46 controls fluid flow through more than one of the swirl nozzles 40 at a time.

The controller 50 controls the valve 46 to achieve a desired amount of flow through the swirl nozzle 40 to contribute or establish the desired swirl upstream of the impeller 26. In embodiments where the amount of fluid flow through the swirl nozzle 40 corresponds to or is proportional to the amount of swirl in the intake passage, the controller 50 causes the valve 46 to allow fluid to flow through the swirl nozzle 40 in an amount that will result in the desired swirl.

In this example embodiment, the outlet of the swirl nozzle 40 has an adjustable outlet direction to vary the way in which fluid is introduced by the swirl nozzle 40 into the intake passage. The outlet direction is varied in this example by changing the orientation or position of the nozzle outlet relative to the intake passage. The outlet end of the swirl nozzle 40 can be moved into more than one oblique angle relative to the primary flow direction 52 within the intake passage of the inlet 22. The controller 50 adjusts the position or orientation as may be needed to achieve a desired swirl by causing an actuator (not shown) to change the position or orientation from that shown in solid lines to that shown in broken lines in FIG. 2. In another embodiment, the swirl nozzle outlet includes an internal deflector or vane that may be adjusted to control the direction of fluid exiting the swirl nozzle.

The controller 50 controls the swirl nozzles 40 to achieve swirl in the intake passage downstream of the inlet guide vanes 24 and upstream of the impeller 26 to ensure a desired characteristic of fluid encountering the leading edges of the impeller blades 28. For example, the swirl resulting from fluid introduced by the swirl nozzles 40 provides a desired incidence angle of the fluid encountering the impeller blades 28 along at least some of the length of the leading edges of the blades 28 between the hub 30 and the shroud 32. In some embodiments, a desired incidence angle is achieved along substantially all of the length of the leading edges of the blades 28.

The swirl introduced upstream of the impeller 26 in some embodiments results in different flow angles at different portions of the leading edges. In other words, the swirl introduced by the swirl nozzles 40 varies the incidence angle along the leading edges of the impeller blades 28 so that the incidence angle is different for different portions of the leading edges. Optimizing the flow angle at different spanwise locations of the impeller blades 28 contributes to or achieves improved compressor efficiency and surge margin for a variety of operating conditions.

Another characteristic that can be controlled or optimized through operation of the swirl nozzles 40 is the pressure ratio at the impeller.

The swirl introduced by the swirl nozzles 40 contributes to or achieves greater compressor efficiency even in conditions such as part-load conditions. Including swirl nozzles 40 downstream of the inlet guide vanes 24 and upstream of the impeller 26 allows for realizing the benefits of inlet guide vanes while avoiding any downside that may be associated with inlet guide vanes under a variety operating conditions.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A compressor, comprising:

an inlet defining an intake passage;

a plurality of inlet guide vanes within the intake passage, fluid flow through the plurality of inlet guide vanes into the intake passage being selectively adjustable to control fluid flow through at least a portion of the intake passage downstream of the plurality of inlet guide vanes;

an impeller including a plurality of blades, the impeller directing fluid from the intake passage toward an outlet; and a plurality of swirl nozzles having outlets positioned downstream of the plurality of inlet guide vanes and upstream of the impeller, the plurality of swirl nozzles being configured to introduce fluid into the intake passage to cause swirl of fluid in the intake passage between the plurality of inlet guide vanes and the impeller, wherein the impeller includes a hub at a center of the blades, the impeller includes a shroud near radially outer ends of the blades, the leading edges of the blades have a length between the hub and the shroud, the swirl of fluid in the intake passage caused by the plurality of swirl nozzles establishes a varying incidence angle of fluid encountering the impeller blades along at least leading edges of the blades, the established varying incidence angle achieves a selected compressor efficiency, the established varying incidence angle varies along substantially an entire length of the leading edges of the blades, and the incidence angle is different for different portions of the leading edges.

2. The compressor of claim 1, comprising at least one control valve, wherein the plurality of swirl nozzles receive fluid from the outlet and the at least one control valve controls an amount of the received fluid that is introduced into the intake passage.

3. The compressor of claim 2, wherein the at least one control valve controls the amount of the fluid from the outlet provided to more than one of the plurality of swirl nozzles.

4. The compressor of claim 2, wherein the at least one control valve comprises a plurality of control valves and each of the plurality of swirl nozzles is associated with one of the plurality of control valves.

5. The compressor of claim 1, wherein a direction of fluid introduction into the intake passage from at least some of the swirl nozzles is selectively adjustable to change a characteristic of the swirl of fluid.

6. The compressor of claim 1, wherein the plurality of swirl nozzles are equidistantly spaced around a circumference of the intake passage.

7. The compressor of claim 1, comprising a controller that controls at least one of an amount of fluid flowing through the plurality of swirl nozzles and a direction of fluid flow from the plurality of swirl nozzles.

8. The compressor of claim 7, wherein the controller controls a flow rate of fluid upstream of the impeller.

9. The compressor of claim 7, wherein the controller controls an incidence angle of fluid flow onto the blades of the impeller.

10. The compressor of claim 7, wherein the controller determines when the compressor operates in a part-load condition and controls at least one of the amount of fluid flow through the plurality of swirl nozzles and the direction of fluid flow from the plurality of swirl nozzles based on the part-load condition.

11. The compressor of claim 10, wherein the controller increases the amount of fluid flow through at least one of the plurality of swirl nozzles when the compressor operates in the part-load condition.

12. The compressor of claim 10, wherein the controller increases the amount of fluid flow through all of the plurality of swirl nozzles when the compressor operates in the part-load condition.

13. The compressor of claim 1, wherein the established varying incidence angle is optimized for each location along the length of the leading edges of the blades.

* * * * *